United States Patent [19]

Lattmann et al.

[11] 4,169,632

[45] Oct. 2, 1979

[54] PNEUMATIC SYSTEM FOR FEEDING A PLURALITY OF CARDS WITH OPEN FIBER FLOCKS

[75] Inventors: Werner Lattmann; Rudolf Wildbolz, both of Winterthur, Switzerland

[73] Assignee: Rieter Machine Works, Limited, Winterthur, Switzerland

[21] Appl. No.: 826,234

[22] Filed: Aug. 19, 1977

[30] Foreign Application Priority Data

Aug. 24, 1976 [CH] Switzerland ..... 10699/76

[51] Int. Cl.[2] ..... B65G 53/06; B65G 53/50

[52] U.S. Cl. ..... 406/93; 406/99; 406/156; 406/168

[58] Field of Search ..... 302/3, 27, 28, 39, 59; 19/105

[56] References Cited

U.S. PATENT DOCUMENTS

| | | | |
|---|---|---|---|
| 2,918,330 | 12/1959 | Pfening | 302/28 |
| 3,787,093 | 1/1974 | Hanselmann et al. | 302/28 |
| 3,851,925 | 12/1974 | Roberson | 302/28 |
| 3,865,439 | 2/1975 | Moser et al. | 302/59 |
| 4,045,091 | 8/1977 | Beneke | 302/28 |

FOREIGN PATENT DOCUMENTS

| | | | |
|---|---|---|---|
| 1254532 | 11/1967 | Fed. Rep. of Germany | 302/27 |

*Primary Examiner*—Robert B. Reeves
*Assistant Examiner*—Jeffrey V. Nase
*Attorney, Agent, or Firm*—Kenyon & Kenyon

[57] ABSTRACT

Each card is interconnected to a multiplicity of pneumatic feed ducts via a branch duct which can be selectively placed in communication with any one of the feed ducts. Each branch duct includes a plurality of openings near one end, each of which is opened or closed relative to a feed duct by means of a sliding baffle. In addition, the upstream end of each branch duct is open to the atmosphere so that the same constant air pressure prevails in all of the feed chutes to the various cards.

13 Claims, 8 Drawing Figures

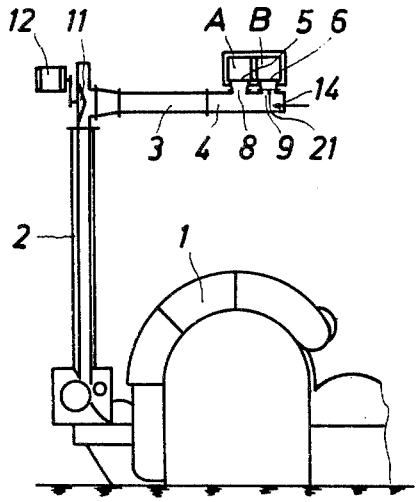
FIG. 2
FIG. 8
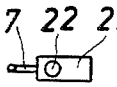
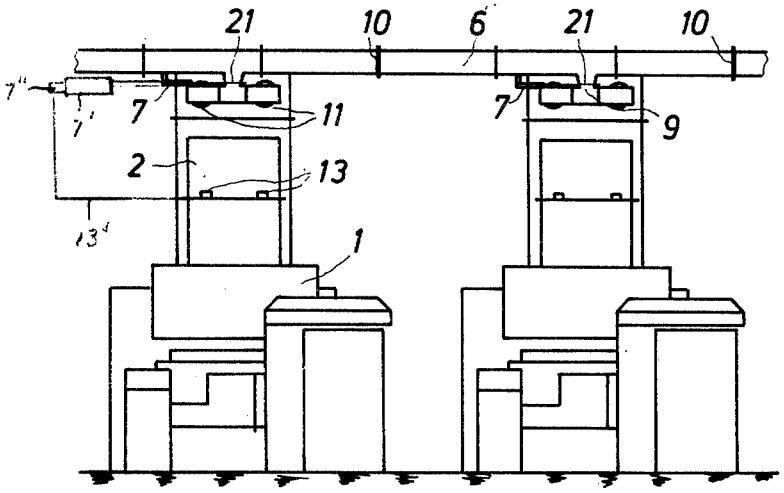
FIG. 3

PNEUMATIC SYSTEM FOR FEEDING A PLURALITY OF CARDS WITH OPEN FIBER FLOCKS

This invention relates to a pneumatic system for feeding a plurality of cards with open fiber flocks.

As is known, various types of pneumatic systems have been used for feeding a plurality of cards with open fiber flocks. In some cases, a single feed duct in which flock is pneumatically transported via an airstream has been used to feed the flock to the cards via a branch duct and a flock feed chute connected to each card.

A pneumatic card feeding device is also known, as described in German patent application DOS No. 2,242,038, in which a plurality of feed ducts, each of which carries a different type of fiber material, is joined to each card feed chute of a number of cards. In this structure, the head of each chute is provided with a device which is arranged to connect one or the other of the feed ducts to the card chute. In this manner, each chute can be fed with any of the fiber material types which are carried in the feed ducts. This card feeding device, however, has a number of disadvantages. For example, the fiber flocks are not fed evenly into the feed chutes which are connected to the cards. Thus, a horizontal level of the fiber flocks is not obtained within the chutes. Further, because there are variations in the fiber flock supply to the feed chutes as well as in the air pressure within each feed chute, the cards cannot produce an even fiber web.

Accordingly, it is an object of the invention to provide a pneumatic system for feeding in fiber flock from a plurality of feed chutes to each card of a plurality of cards in a uniform manner.

It is another object of the invention to provide a pneumatic system for feeding each feed chute of a plurality of cards with different types of fiber material which are carried in feed ducts.

It is another object of the invention to provide a pneumatic system in which the same air pressure prevails in all feed chutes to cards independently of whether or not fiber flocks are supplied.

It is another object of the invention to provide a pneumatic system for feeding a plurality of cards with open fiber flocks wherein substantially identical fiber webs are produced in each card.

Briefly, the invention provides a pneumatic system for feeding a plurality of cards with open fiber flocks which includes a plurality of feed ducts for pneumatically transporting flock; a branch duct for each card selectively connected to each of the feed ducts to receive a flow of flock therefrom and a flock feed chute for each card connected to the end of the branch duct and to a respective card to deliver flock to the card.

In addition, a means is provided for selectively opening and closing the openings of each branch duct in order to control the flow of flock to each card from a respective feed duct.

Each branch duct also has an open end upstream of the openings so as to open the branch duct to the atmosphere so that a lower pressure prevails in the branch duct than in the feed duct.

In order to prevent any escape of fiber flock through the open end of the branch ducts, a profiled member is disposed at the open end. Alternatively, the branch duct may be extended beyond the feed ducts to prevent the escape of flocks.

In order to convey the flock though the branch duct, a suction fan may be provided between each branch duct and a respective chute. Alternatively, use may be made of a blower fan at the open end of each branch duct in order to blow air into the branch duct to facilitate conveyance of the fiber flock therein.

These and other objects and advantages of the invention will become more apparent from the following detailed description and appended claims taken in conjunction with the accompanying drawings in which:

FIG. 2 illustrates a view taken on line II—II of FIG. 1;

FIG. 3 illustrates a side view of the cards of FIG. 1 as viewed from the web doffing side;

FIG. 8 illustrates a view of a detail of FIG. 3.

Figure 1:
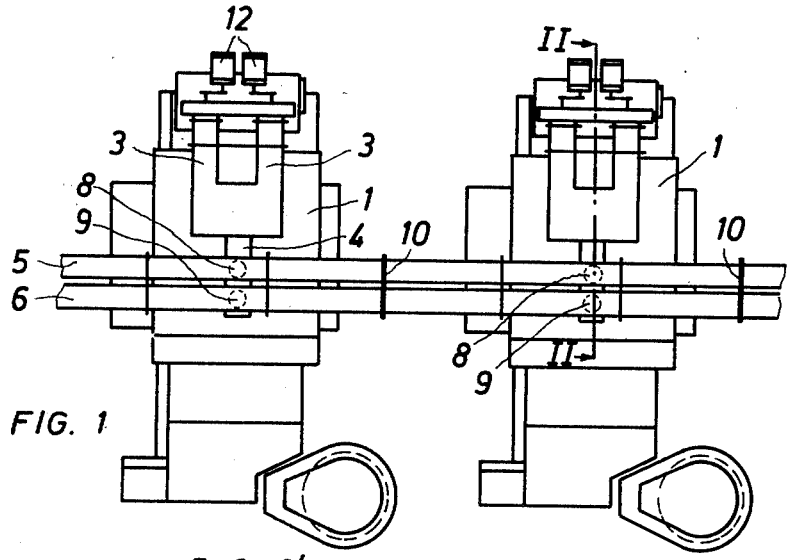
FIG. 1 illustrates a plan view of two cards of a plurality of cards which are fed by two feed ducts.

Referring to FIG. 1, two cards 1 of a plurality of cards in a carding plant are fed fiber flocks from a pneumatic system which employs a pair of feed ducts 5, 6 for transporting the flock pneumatically. As shown in FIG. 2, each card 1 has a vertically arranged feed chute 2 which is joined via two branches 3 (FIG. 3) of a branch duct 4 to the two feed ducts 5, 6. Alternatively, any number of feed ducts may be joined to the branch duct 4 other than the two ducts 5, 6 shown.

Referring to FIG. 2, each branch duct is selectively connected to each of the feed ducts 5, 6 via connections for openings 8, 9 so that flock can be transferred from the feed ducts 5, 6 into the branch duct 4. In addition, means are provided for selectively opening and closing each of the openings 8, 9 to control the flow of flock to each card 1. In this regard, the means for opening and closing the opening 8, 9 is in the form of sliding baffles 21 each of which is guided in a joint between a duct 5, 6 and the branch duct 4. Each baffle 21 is provided with an opening 22 (FIG. 8) which corresponds to the respective opening 8, 9 and is shifted by means of a rod 7 which is disposed in parallel to the feed ducts 5, 6 (FIG. 3). Thus, by moving the rods 7, the baffles 21 can either seal the openings 8, 9 or open the openings 8, 9 respectively. An exchangable hydraulic or pneumatic cylinder 7' can be detachably mounted on each rod 7 to activate the to-and-fro movement of the rod 7 and thus, the sealing or opening of the joint openings 8, 9.

Therefore, one exchangable hydraulic cylinder 7' is provided at each branch duct 4 for all the feed ducts joined to the branch duct, which cylinder is mounted on the rod of the feed duct to which the flocks are supplied into the chute.

In addition, the feed ducts 5, 6 are provided with sliding baffles 10 (FIG. 3) which are arranged between each card. These baffles 10 allows the flow of material in the ducts 5, 6 to be interrupted in such a manner that, for example, if the baffle 10 between the two cards 1 and the ducts 5 are closed, a different flock fiber material can be supplied from the left hand side to the left hand card and to the right hand card from the right hand side via the same feed duct 6.

Referring to FIG. 2, each branch duct 4 is also provided with an air intake open end 14 upstream of the openings 8, 9 to draw in air.

Referring to FIGS. 2 and 3, a fan 11 is disposed in communication with each branch 3 of the branch duct 4. Each fan 11 is driven via a motor 12 at constant rotational speed during the operating time of a card 1 to act as a means for causing a flow of air along the branch of the branch duct 4 from the connections 8, 9 towards the card.

Referring to FIG. 3, each flock feed chute 2 is provided with two light beam barriers 13 which perform a double control function. On the one hand, the barriers 13 control the hydraulic cylinder 7 (via a control-line 13' and a control-unit 7'') which actuates the rod 7 to move the baffle to-and-fro across the opening 8. In this case, the hydraulic cylinder 7' is mounted on the rod 7 of the corresponding feed duct 5. If a light beam barrier 13 is open, that is, if material is to be supplied, the sliding baffle 21 holds the opening 8 open and, if the light beam barrier is covered by fiber flock, that is, if no material is to be supplied, the sliding baffle 21 seals the opening 8. On the other hand, the light beam barriers 13 also control the fiber flock supplied to the chute 2 in such a manner that a horizontal flock level is obtained such as shown in Swiss Pat. No. 546,833 and U.S. Pat. No. 3,865,439.

During operation, a fiber flock material A is pneumatically transported through the duct 5 while a different fiber flock material B, e.g., of different origin, is transported via the duct 6. If the cards 1 are to be fed with the material A, the openings 9 of the duct 5 are sealed by the sliding baffles 21, which is always the same when the hydraulic cylinder 7' is removed. The material B thus bypasses the cards 1 and is fed to other cards (not shown) of the carding plant. The openings 8 of the duct 5 are then controlled by the sliding baffle 21 which, in turn, is controlled by the position of the rod 7 via the light beam barriers 13, the control-line 13', the control unit 7'' and the hydraulic cylinder 7' mounted on the rod 7. If the opening 8 is not sealed, which will be the case during most of the time, the fiber flock material A flows via the branch duct 4 into the feed chute 2. At this time, the fans 11 draw the flocks of the material A via the openings 8 from the feed duct 5 through the branch duct 4 and branches 3 into the feed chute 2. The fiber flocks are then separated from the transporting air in the feed chute in known manner. For example, the flocks are deposited and condensed in the chute 2 while the transporting air is drained via vertical slots between spaced apart strips located above the fiber flock column in the chute 2 such as described in Swiss Pat. No. 437,063 and U.S. Pat. No. 3,708,210.

Since the branch duct 4 is open at the end 14, air from the surrounding room is also drawn into the chute by the fans 11 independently of whether the opening 8 is opened or sealed. Surprisingly, it has been found that if the face side (or end) 14 of the branch duct 4 is not sealed against the surrounding room but is connected to the atmospheric pressure prevailing in the surrounding room, the same constant air pressure prevails in the chutes 2 independently of whether or not fiber flocks are supplied. Thus, no pressure impulses are exerted on the fiber flock column by the opening and sealing of the connecting openings by the sliding baffles 21. As a result, an ideally even card feed is achieved.

Since the same air pressure prevails in all of the chutes 2 of the card feeding system, an almost identical flock output is delivered by each chute 2 at the same filling level. As a result, all the cards 1 can produce an almost identical web.

If no material is fed from feed duct 6 to the chute, then the cylinder 7' is removed from this duct (the cylinder 7' being mounted on the rod 7 of the duct 5 which delivers material into the chute). This cylinder 7' can only be removed from the rod 7 when the connected sliding baffle 21 has closed the opening 9. In other words, only the hydraulic cylinder 7' can actuate the baffle 21 for opening the opening 9, so that when the cylinder 7' is not mounted on the rod 7 of the corresponding duct 6 the opening 9 is always closed.

Figure 4:
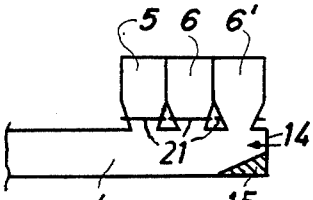
FIG. 4 illustrates a cross sectional view of a multiplicity of feed ducts connected to a branch duct in accordance with the invention.

Referring to FIG. 4, in order to prevent fiber flocks from escaping to the surrounding room via the open end 14, a profiled member 15 is disposed within the branch duct 4 at the open end 14. Alternatively, the branch duct 4 may be extended beyond the feed ducts in a direction away from the feed chute 2 (not shown).

Figure 5:
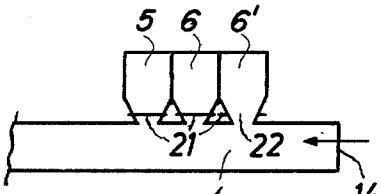
FIG. 5 illustrates a modified branch duct in accordance with the invention.

As shown in FIGS. 4 and 5, the branch duct 4 may be joined to three or more feed ducts 5, 6, 6'.

Figure 6:
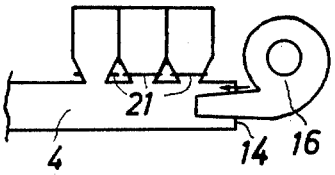
FIG. 6 illustrates a branch duct provided with a fan for generating a lower pressure in the fan duct.
Figure 7:
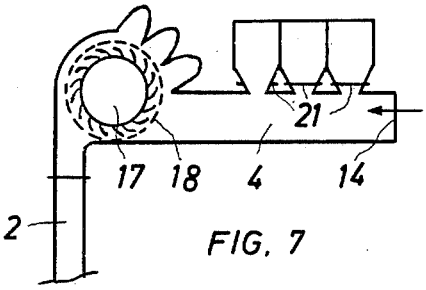
FIG. 7 illustrates a modified branch duct having a transverse flow fan therein.

The use of two fans 11 to draw in a fiber flock effects a particularly even level of chute filling. However, constant air pressure also prevails in the chute 2 if only one fan is arranged between the chute 2 and the feed ducts 5, 6. In this case, the arrangement of two branches 3 in the branch duct 4 can be eliminated. Also, the air pressure in the chute can be maintained constant if additional transporting air is blown in via the open end 14 by a radial blower fan 16 as shown in FIG. 6. In this case, an injector effect is obtained. Alternatively, as shown in FIG. 7, the same effect can be obtained if additional transporting air is supplied by a transverse flow fan 17 which is surrounded by a sieve-type net 18.

The above described pneumatic card feed system provides numerous advantages. For example, within a group of cards, very even and almost identical fiber webs can be mutually produced. Also, the fiber webs of two different card groups supplied from the same feed duct present the same quality. Further, individual or all feed ducts of a group can be extended onto a second or third group without detrimentally influencing the web uniformity of the cards.

Use of the pneumatic card feed system allows any combination of the material supplied to any number of cards to be effective.

What is claimed is:

1. A pneumatic system for feeding a plurality of cards with pneumatically transportable fiber flocks, said system comprising a plurality of feed ducts for pneumatically transporting flock along said ducts;

a branch duct for each card having selectively openable connections to each of said feed ducts to receive a flow of flock therefrom, means in communication with each respective branch duct for causing a flow of air along said branch duct from said connections towards said cards;

an air intake in each said branch duct upstream of said connections; and a flock feed chute for each card, each feed chute being connected to a respective branch duct downstream of said connections and to a respective card to deliver flock to said respective card.

2. A pneumatic system as set forth in claim 1 wherein said air intake is an open end of said branch duct and which further comprises a profiled member in each branch duct at said open end.

3. A pneumatic system as set forth in claim 1 wherein each said branch duct extends from said feed ducts in a direction away from said feed chute.

4. A pneumatic system as set forth in claim 1 wherein said means comprises a suction fan between each chute and said feed ducts.

5. A pneumatic system as set forth in claim 4 wherein said fan is a transverse flow fan.

6. A pneumatic system as set forth in claim 1 wherein at least one branch duct has two branches connected to a respective feed chute and said means comprises a pair of suction fans coordinated to said branches between a respective chute and said feed ducts.

7. A pneumatic system as set forth in claim 1 which further comprises a blower fan in said air intake of a respective branch duct.

8. The combination comprising at least a pair of cards;

a plurality of feed chutes, each said feed chute being connected to a respective card to deliver flock to said card;

a plurality of feed ducts for pneumatically transporting flock;

a plurality of branch ducts, each said branch duct having a plurality of openings near one end, each said opening being in communication with a respective feed duct to permit a flow of flock to pass into said respective branch duct, each said branch duct being connected at an opposite end to a respective feed chute to deliver flock thereto;

a fan in each branch duct for drawing flock from at least one of said feed ducts through a respective one of said openings to flow through one of said branch ducts into one of said feed chutes;

each said branch duct having an air intake opening at said one end upstream of said openings whereby the same constant air pressure prevails in said feed chutes; and means for selectively opening and closing said openings of each respective branch duct to control the flow of flock to each card from a respective feed duct.

9. The combination as set forth in claim 8 wherein each branch duct includes a profiled member at said one end to prevent escape of flocks from said respective branch duct.

10. The combination as set forth in claim 8 wherein each branch duct has said one end extending beyond said feed ducts.

11. The combination as set forth in claim 8 wherein said fan is disposed between each branch duct and a respective feed chute to draw a flow of flock through said branch duct into said feed chute.

12. The combination as set forth in claim 8 wherein said fan is a blower fan at said one end of each branch duct to blow air into said branch duct.

13. The combination as set forth in claim 8 wherein said means includes a baffle slidably mounted over each respective opening and a rod connected to each baffle for guiding said baffle between a position over a respective opening and a position removed from said opening.

* * * * *